US011197349B2

(12) United States Patent
Maher et al.

(10) Patent No.: US 11,197,349 B2
(45) Date of Patent: Dec. 7, 2021

(54) HEATING ROD HAVING A NICKEL PLATED CONTACT SHEET

(71) Applicant: BorgWarner Ludwigsburg GmbH, Ludwigsburg (DE)

(72) Inventors: Anthony Maher, Foynes (IE); Thomas O'Carroll, Causeway (IE); Kevin Dukes, County Kerry (IE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 366 days.

(21) Appl. No.: 15/486,910

(22) Filed: Apr. 13, 2017

(65) Prior Publication Data

US 2017/0303339 A1 Oct. 19, 2017

(30) Foreign Application Priority Data

Apr. 15, 2016 (DE) ..... 10 2016 107 043.2

(51) Int. Cl.

| | |
|---|---|
| ***H05B 3/00*** | (2006.01) |
| ***H05B 3/42*** | (2006.01) |
| ***H05B 3/06*** | (2006.01) |
| ***H05B 3/46*** | (2006.01) |

(52) U.S. Cl.

CPC ..... *H05B 3/0004* (2013.01); *H05B 3/06* (2013.01); *H05B 3/42* (2013.01); *H05B 3/46* (2013.01); *H05B 2203/02* (2013.01); *H05B 2203/023* (2013.01)

(58) Field of Classification Search

CPC ..... H05B 3/141; H05B 3/26; H05B 3/262; H05B 3/42; H05B 3/46

USPC ..... 219/544

See application file for complete search history.

(56) References Cited

U.S. PATENT DOCUMENTS

| | | | | |
|---|---|---|---|---|
| 2,242,344 | A * | 5/1941 | Cito | H05B 3/50 338/51 |
| 4,242,567 | A * | 12/1980 | Carter | A45D 2/001 132/224 |
| 4,814,584 | A * | 3/1989 | Bohlender | H05B 3/14 219/505 |
| 5,420,395 | A * | 5/1995 | Hyllberg | G03G 15/0233 219/470 |
| 6,260,612 | B1 * | 7/2001 | Nakamura | F28D 9/0075 165/149 |
| 8,481,899 | B2 * | 7/2013 | Jun | H05B 3/50 219/202 |
| 2008/0023467 | A1 * | 1/2008 | Sakurai | H01C 17/07 219/553 |
| 2008/0138052 | A1 * | 6/2008 | Wu | F24H 3/0452 392/465 |
| 2011/0186564 | A1 * | 8/2011 | Lauth | H05B 3/42 219/548 |
| 2011/0272392 | A1 | 11/2011 | Döhring et al. | |
| 2013/0224080 | A1 * | 8/2013 | Ishihara | H05B 3/06 422/174 |

(Continued)

FOREIGN PATENT DOCUMENTS

CN 102171516 A 8/2011

*Primary Examiner* — Erin E McGrath

(74) *Attorney, Agent, or Firm* — Bose McKinney & Evans LLP

(57) ABSTRACT

Disclosed is a heating rod comprising a ceramic heating element, a strip shaped contact sheet, and a housing in which the heating element and the contact sheet are arranged. The contact sheet is coated with nickel.

25 Claims, 2 Drawing Sheets

(56) References Cited

U.S. PATENT DOCUMENTS

| | | | | |
|---|---|---|---|---|
| 2014/0034634 | A1 | 2/2014 | Waechter et al. | |
| 2014/0202670 | A1* | 7/2014 | Tylutki | F28F 9/001 165/149 |

* cited by examiner

HEATING ROD HAVING A NICKEL PLATED CONTACT SHEET

RELATED APPLICATIONS

This application claims priority to DE 10 2016 107 043.2, filed Apr. 15, 2016, the entire disclosure of which is hereby incorporated herein by reference in its entirety.

BACKGROUND AND SUMMARY

The present invention relates to a heating rod of the type disclosed in DE 10 2012 107 113 A1. Such heating rods can be used for heating the interior of vehicles, for example.

Especially in high voltage applications, good electrical contact between the contact sheet of a heating rod and the heating element or elements is desirable. Electrical contacts tend to deteriorate due to corrosion or oxidation. Moreover, ceramic heating elements, especially PTC heating elements on the basis of barium titanate, are susceptible to resistance drift due to diffusion of iron atoms from the contact sheet into the heating element. Traces of iron are present in many metals and alloys, e.g., in copper sheets, so that such contact sheets may cause problems with heating elements.

This disclosure shows how these disadvantages can be overcome.

Plating the contact sheets of heating rods with tin or nickel reliably prevents corrosion and oxidation. Thereby, a reliable electrical contact between a contact sheet and a ceramic heating element can be ensured, e.g., a PTC heating element on the basis of barium titanate. In addition, a tin or nickel coating prevents traces of iron to diffuse from the contact sheet to the heating element. This is an important advantage because even traces of iron can cause resistance drift in ceramic heating elements, like PTC heating elements on the basis of barium titanate.

Tin coating is disadvantageous in that it makes a crackling noise at temperatures above 200° C. This is because tin melts at 232° C. and softens below this temperature. Thermal expansion of the tin layer on the contact sheet causes the crackling noise which is undesirable in many applications, like, e.g., in vehicles where the noise might be heard by a driver. Nickel melts at a much higher temperature and therefore does not have this disadvantage.

Thus, by using nickel-plated contact sheets this disclosure provides a reliable electrical contact without causing undesirable noise.

An advantageous refinement of this disclosure is that the contact sheet is made of copper. Copper has a very good electrical conductivity. Moreover, a nickel coating is very durable on a copper sheet.

The nickel coating may be applied on the contact sheet by electro plating. Thereby both the front and the back side can be provided with a nickel coating. It is more economical to apply the nickel coating to both sides of a contact sheet although it is needed only on one side.

Repeatedly heating a heating rod to temperatures of about 200° C. or more causes significant thermal stress. Thermal expansion coefficients of various parts of a heating rod, especially of the contact sheet and electrical isolation or other parts can cause mechanical stress which may lead to cracks or other damages. By providing the contact sheet with slits originating from a longitudinal edge of the contact sheet the effects of thermal expansion can be mitigated as the slits in the strip shaped contact sheet allow it to easily expand or contract in its longitudinal direction. Hence, differences in the thermal expansion coefficient of the contact sheet and other parts of the heating rod no longer cause significant mechanical stress that might damage the heating rod.

Another advantageous refinement of this disclosure is that some of the slits originate from a first longitudinal edge of the contact sheet and some of the slits originate from a second longitudinal edge of the contact sheet. If slits originate from both longitudinal edges of the contact sheet, thermal stress can be better eliminated. Preferably, the slits originate alternatively from opposite longitudinal edges of the contact sheet.

The slits can be oriented perpendicular to the longitudinal direction of the strip shaped contact sheet. It is also possible that the strips are slanted relative to the longitudinal direction of the contact sheet.

The slits can have various shapes. For example, the slits may be simple rectangular cuts or the ends of the slits may be rounded. Preferably the slits narrow from their origin at one of the longitudinal edges to their end.

The heating rod may comprise only a single ceramic heating element or several ceramic heating elements. The ceramic heating element(s) may be PTC heating elements, for example heating elements on the basis of barium titanate.

Another advantageous refinement of this disclosure is that the heating rod comprises a plurality of ceramic heating elements. In this case, it is advantageous if at least one of the slits is between each section of the contact sheet covering a heating element and another section of the contact sheet covering a neighboring heating element. It is especially advantageous if there are two slits originating from opposite longitudinal edges of the contact sheet arranged between each section of the contact sheet covering one of the heating elements and another section of the contact sheet covering a neighboring heating element. In this way, the slits do not affect the contact surfaces of the contact sheet with the ceramic heating elements.

Another advantageous refinement of this disclosure is that the slits each extend over at least two-thirds of the width of the contact sheet. Preferably the slits each extend over at least three-quarters of the width of the contact sheet. In principle, the contact sheet can expand or contract in longitudinal direction the more easily, the longer the slits are. Slits that extend over less than two thirds of the width of the contact sheet are not very effective in eliminating thermal stress.

Another advantageous refinement of this disclosure is that the slits each extend at most over nine tenths of the width of the contact sheet. The longer the slits are, the less material of the contact sheet is present between the end of the slit and the longitudinal edge. Hence, the longer the slits are, the higher is the electric resistance of the contact sheet where its effective width is reduced by the slits. If the slits each extend at most over nine tenths of the width of the contact sheet, the overall electrical resistance of the contact sheet is still small enough to allow effective operation of the heating rod.

Heating rods can comprise a single contact sheet if the housing of the heating rod is also used to electrically contact the ceramic heating element(s). It is also possible to provide a heating rod with two contact sheets, between which the heating element or elements are arranged.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
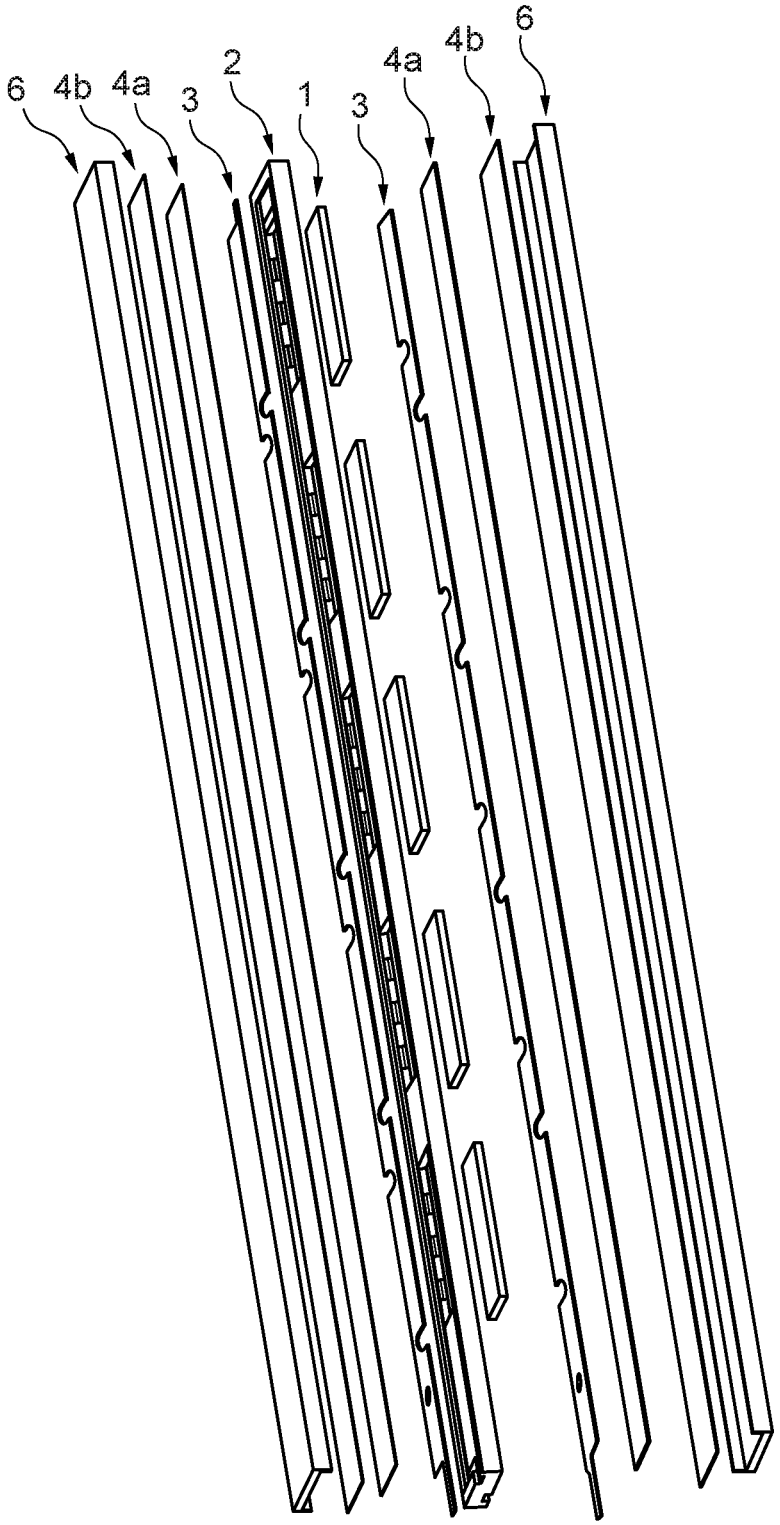
FIG. 1 shows an exploded view of a heating rod.

The heating rod shown in the attached FIG. 1 comprises several ceramic heating elements 1 although the heating rod might also be configured with only a single ceramic heating element 1. The ceramic heating elements 1 are resistive heating elements which may be PTC heating elements, for example on the basis of barium titanate.

The heating elements 1 are held in a plastic frame 2 and electrically contacted by a first strip-shaped contact sheet 3 as well as by a second strip-shaped contact sheet 3. As can be seen in the figure, the heating elements 1 are arranged between the strip-shaped contact sheets 3. The contact sheets are electrically isolated from the housing 6 by insulations layers 4*a*, 4*b*, e.g., a ceramic plate 4*a* and a polymer film 4*b*.

The ceramic heating elements 1, the plastic frame 2, and the contact sheets 3 are arranged in a housing. The housing is a metal tube formed by a first and a second housing part 6. The first and the second housing part 6 are profiles which have an open cross section, e.g., a U-shaped cross section. The open cross section of each profile is closed by the other profile when the heating rod is assembled. The housing 6 might also be provided as a single piece.

The heating rod shown schematically in FIG. 1 comprises two contact sheets 3 contacting the heating elements 1. Instead of a second contact sheet 3, the heating elements 1 might also be connected to ground by the housing 6.

The contact sheet(s) 3 are made of copper and bear a nickel coating. The nickel coating may be applied by electroplating.

Figure 2:
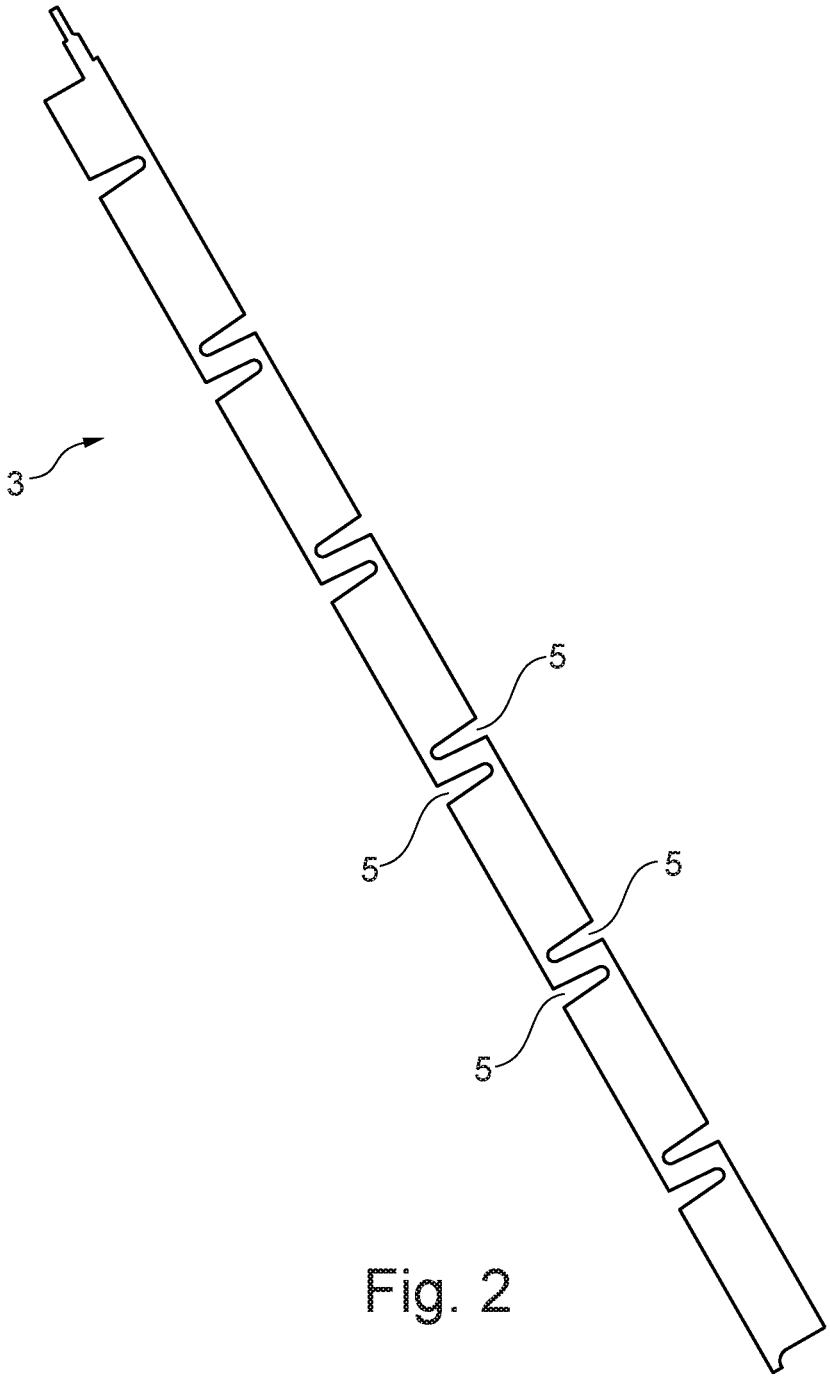
FIG. 2 shows an embodiment of a slotted contact sheet of a heating rod.

FIG. 2 shows an embodiment of a contact sheet 3 for a heating rod as shown in FIG. 1. The strip-shaped contact sheet 3 is provided with slits 5, which may also be called "cuts" or "notches." As can be seen in FIG. 2, the slits 5 extend from a front surface of the contact sheet 3 all the way through to its back side. The slits 5 originate from a longitudinal edge of the contact sheet 3 and run substantially traverse to the longitudinal direction of the contact sheet 3. The slits 5 can also be oriented perpendicular to the longitudinal direction of the contact sheet 3 or be slanted.

The slits 5 alleviate thermal stresses caused by differences in thermal expansion of the various parts of the heating rod. The slits 5 allow the contact sheet 3 to easily extend or contract in its longitudinal direction thereby alleviating stresses caused by thermal extension.

The slits 5 originate alternately from opposite longitudinal edges of the contact sheet 5. For example, a pair of slits 5 originating from opposite longitudinal edges of the contact sheet 3 are arranged between a section of the contact sheet contacting one of the heating elements 2 and another section of the contact sheet 3 contacting a neighboring heating element 2.

Each slit 5 should extend over at least two thirds of the width of the contact sheet 3, for example over at least over three quarters of the width of the contact sheet 3. In the embodiment shown, each slit 5 extends over at least four fifths of the width of the contact sheet 5, although shorter slits 5 may suffice.

The slits 5 should not be too long as that would increase the electrical resistance of the contact sheet 3. In the embodiment shown, the slits 5 each extend over less than nine tenths of the width of the contact sheet 3. The slits 5 may be cuts of a constant width. In the embodiment shown, the width of the slits 5 decreases from their origin to their end.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE SIGNS

1 housing
2 heating element
3 contact sheet
4 isolation layer
5 slit

What is claimed is:

1. A heating rod, comprising:

a plurality of ceramic heating elements arranged next to one another;

a strip-shaped contact sheet covering the ceramic heating elements; and a housing in which the heating elements and the contact sheet are arranged;

wherein the contact sheet is coated with nickel and has multiple slits arranged along an edge thereof, at least one of the slits being positioned over a pair of adjacent ceramic heating elements;

further wherein the slits are configured to allow the contact sheet to expand or contract in its longitudinal direction, whereby stresses caused by thermal expansion are reduced.

2. The heating rod according to claim 1, wherein the contact sheet is made of copper.

3. The heating rod according to claim 1, wherein the ceramic heating elements are PTC heating elements.

4. The heating rod according to claim 1, wherein the housing is a tube.

5. The heating rod according to claim 1, wherein both sides of the contact sheet are coated with nickel.

6. The heating rod according to claim 1, wherein the slits originate from the edge of the contact sheet.

7. The heating rod according to claim 1, further comprising at least one additional slit originating from a second edge of the contact sheet.

8. The heating rod according to claim 1, wherein the slits extend over at least two thirds of the width of the contact sheet.

9. The heating rod according to claim 8, wherein the slits extend over at least three quarters of the width of the contact sheet.

10. The heating rod according to claim 8, wherein the slits extend at most over nine tenths of the width of the contact sheet.

11. The heating rod of claim 1, wherein the ceramic heating elements form pairs of adjacent ceramic heating elements, further wherein the contact sheet has at least two of said slits positioned over one of the pairs of adjacent ceramic heating elements.

12. The heating rod of claim 1, wherein at least one of the slits is positioned over a location between adjacent heating elements.

13. The heating rod of claim 1, wherein the slits are elongated.

14. The heating rod of claim 1, wherein the slits are open.

15. The heating rod of claim 1, wherein the slits are wedge-shaped.

16. A heating rod, comprising:

a plurality of ceramic heating elements arranged next to one another;

a strip-shaped contact sheet covering the ceramic heating elements; and a housing in which the heating elements and the contact sheet are arranged;

wherein the contact sheet is coated with nickel and has at least two elongated slits positioned over a pair of adjacent ceramic heating elements;

further wherein the at least two slits are configured to allow the contact sheet to expand or contract in its longitudinal direction, whereby stresses caused by thermal expansion are reduced; and wherein the at least two slits comprise multiple slits arranged along an edge of the contact sheet.

17. The heating rod of claim 16, wherein the at least two slits originate from opposite longitudinal edges of the contact sheet.

18. The heating rod of claim 16, wherein the at least two slits are positioned over a location between the two adjacent ceramic heating elements of the pair.

19. The heating rod of claim 16, wherein the slits are open.

20. The heating rod of claim 16, wherein the slits are wedge-shaped.

21. A heating rod, comprising:

a plurality of ceramic heating elements arranged next to one another;

a strip-shaped contact sheet covering the ceramic heating elements; and a housing in which the heating elements and the contact sheet are arranged;

wherein the contact sheet is coated with nickel and has a wedge-shaped slit positioned over a pair of adjacent ceramic heating elements;

further wherein the slit is configured to allow the contact sheet to expand or contract in its longitudinal direction, whereby stresses caused by thermal expansion are reduced.

22. A heating rod, comprising:

a plurality of ceramic heating elements arranged next to one another;

a strip-shaped contact sheet covering the ceramic heating elements; and a housing in which the heating elements and the contact sheet are arranged;

wherein the contact sheet is coated with nickel and has at least two wedge-shaped slits positioned over a pair of adjacent ceramic heating elements;

further wherein the at least two slits are configured to allow the contact sheet to expand or contract in its longitudinal direction, whereby stresses caused by thermal expansion are reduced.

23. The heating rod of claim 22, wherein the at least two wedge-shaped slits comprise multiple slits arranged along an edge of the contact sheet.

24. The heating rod according to claim 23, further comprising at least one additional slit originating from a second edge of the contact sheet.

25. A heating rod, comprising:

a plurality of ceramic heating elements arranged next to one another;

a strip-shaped contact sheet covering the ceramic heating elements; and a housing in which the heating elements and the contact sheet are arranged;

wherein the contact sheet is coated with nickel and has at least two elongated slits positioned over a pair of adjacent ceramic heating elements;

further wherein the at least two slits are configured to allow the contact sheet to expand or contract in its longitudinal direction, whereby stresses caused by thermal expansion are reduced; and wherein the at least two slits are positioned over a location between the two adjacent ceramic heating elements of the pair.

* * * * *